US005139053A

United States Patent [19]

Yokoi

[11] Patent Number: 5,139,053

[45] Date of Patent: Aug. 18, 1992

[54] POSITION DETECTING SYSTEM FOR A HARNESS FRAME IN A WEAVING MACHINE

[76] Inventor: Junichi Yokoi, 11-20 Wakae-Honmachi 2-chome, Higashi-Osaka, Japan

[21] Appl. No.: 637,648

[22] Filed: Jan. 4, 1991

[51] Int. Cl.[5] ..... D03C 13/00

[52] U.S. Cl. ..... 139/82; 139/337; 340/686

[58] Field of Search ..... 187/134, 129; 340/992, 340/686, 687; 139/337, 1 R, 336, 338, 82; 100/99

[56] References Cited

U.S. PATENT DOCUMENTS

| | | | |
|---|---|---|---|
| 2,465,615 | 3/1949 | Svancarek | 139/337 |
| 2,475,549 | 7/1949 | Laplante | 139/337 |
| 2,707,497 | 5/1955 | Bailey et al. | 139/337 |
| 3,594,740 | 7/1971 | Comeau | 340/686 X |
| 3,975,723 | 8/1976 | Bowling et al. | 340/686 X |
| 4,135,554 | 6/1979 | Gotch et al. | 139/337 |
| 4,745,390 | 5/1988 | Oden et al. | 340/686 X |
| 4,781,111 | 11/1988 | Chesnut | 100/99 |
| 4,827,986 | 5/1989 | Tanaka | 139/337 |

FOREIGN PATENT DOCUMENTS

| | | |
|---|---|---|
| 3533336 | 3/1986 | Fed. Rep. of Germany . |
| 3536868 | 4/1986 | Fed. Rep. of Germany . |

*Primary Examiner*—Andrew M. Falik
*Attorney, Agent, or Firm*—Wenderoth, Lind & Ponack

[57] ABSTRACT

A sensor type position detecting mechanism is provided for a harness frame of a weaving machine to detect when the harness frame reaches extreme end positions of its stroke. The detecting mechanism includes at least sensor system provided with a bedplate which is vertically movable along a frame of the weaving machine, a slider device vertically adjustably mounted on the bedplate, and a sensor or sensors attached to the slider device. Because the detecting mechanism can detect when the upper or lower extreme end position of the harness frame stroke has changed, an indication can be provided that there is a need to adjust or take up the slack present in wires connecting the harness frame to a shedding motion mechanism.

18 Claims, 6 Drawing Sheets

POSITION DETECTING SYSTEM FOR A HARNESS FRAME IN A WEAVING MACHINE

BACKGROUND OF THE INVENTION

The present invention relates to a position detecting system which is intended to be applied chiefly to harness frames in a weaving machine.

In an arrangement of a negative type weaving machine, a shedding motion means functions to move the harness frame in one of the upward and downward directions, a pulling means serves to draw the harness frame in the other direction. The shedding motion means and the pulling means are respectively connected to the harness frame through connecting wires.

The connecting wires between the shedding motion means and the harness frame inevitably become gradually slackened in their tension if the weaving machine is operated over a long period of time. This causes the shedding motion means to fail to achieve a predetermined amount of warp shedding, and any resulting sheds in the warps are decreased in size, while at the same time, the other connecting wires are also reduced in their tension.

The foregoing decrease in the warp shedding amount causes a weft to be easily caught in the warps as it is being fed through the sheds formed between the upwardly lifted warps or the downwardly lowered warps and the other warps. This results in a disadvantage of the conventional negative type weaving machines, in which defective products can easily be produced.

Also, the foregoing reduction in the tension of the connecting wires between the shedding motion means and the harness frame and between the pulling means and the harness frame causes the harness frame to fluctuate easily, and if the harness frame fluctuates, the rod eyes located at the upper and lower end portions of the heddles are easily damaged, because the upper and lower edge portions of the harness frame are inserted through the rod eyes via the rods. This is another disadvantage of the conventional negative type weaving machines.

Moreover, fluctuation of the harness frame results also in a disadvantage in which the connecting wires and the eyes or mails of the heddles through which the warps are inserted to lift or lower the warps to form the sheds in them can easily be damaged, and this causes the warp to be readily cut. This disadvantage is still more likely to occur if both connecting wires connected from the shedding motion means to the right hand side and left hand side lower or upper end portions of the harness frame do not have an equivalent amount of slack.

Substantially all of the weaving machines recently in operation are of the high-speed operation type. Such high-speed operation type weaving machines are inevitably especially affected by the foregoing disadvantages.

If the connecting wires between the shedding motion means and the harness frame become slackened in their tension, the foregoing disadvantages are unavoidable. The occurrence of slack in the connecting wires is also substantially inevitable in the negative type weaving machines. Therefore, it will occasionally become necessary to adjust the working length of the connection wires between the harness frame and the shedding motion means to regulate the level of the harness frame, such as described in, for example, German Auslegeschrift De-A 35 33 336 and also German Auslegeschrift DE-A 35 36 868.

In the foregoing prior art references, however, while mention is made of the necessity of reducing the slack in the connecting wires, no means is disclosed which allows the slack of the connecting wires to be detected. This is true of other conventional weaving machines. That is to say, in the conventional type weaving machines, when the connecting wires from the shedding motion means to the harness frames slacken, it is difficult or impossible to find or know the slack of the connecting wires, and the weaving machines were continuously operated with the slackened connecting wires, thereby resulting in the foregoing disadvantages.

SUMMARY OF THE INVENTION

It is a primary object of the present invention to provide in a weaving machine a position detecting system or means for detecting the position of harness frames.

In order to accomplish the object of the present invention, a weaving machine in which the shedding motion means and pulling means are respectively connected to the harness frames by the connecting wires is provided with a sensor type detecting means which detects when the harness frame is at its extreme upper position of an upward stroke thereof in the direction in which the harness frame is drawn by using a pulling means to pull the harness frame in a direction opposite the direction of the shedding motion. In this case, the relationship between the direction of the shedding motion of the harness frame and that in which the pulling means draw the harness frame is such that the harness frame is moved by the shedding motion means in one of the upward and downward directions, and the harness frame is drawn by the pulling means in the other of the upward and downward directions.

Also, this sensor type detecting means is arranged to be vertically movable for adjustment of the vertical position thereof (i.e. vertically adjustable).

Alternatively, the sensor type detecting means may be used to detect when the harness frame is at the extreme end of the stroke thereof in the direction in which the harness frame is moved by the shedding motion means.

The sensor type detecting means is basically intended to be mounted on a single inside surface portion of one of the two vertical supporting members of the frame of a weaving machine. In this case, such a single inside surface is opposed to a side surface of the harness frame.

Alternatively, the detecting means may be applied to two inside surfaces of the two vertical supporting members of the machine frame.

Moreover, the detecting means may comprise a bedplate vertically movably fitted to one or both vertical supporting members of the machine frame, a slider means vertically movably attached to the bedplate, and a sensor mounted on the slider means.

In operation, the sensor type detecting means is located in a suitable position which is nearer to the pulling means than the extreme upper end of the originally set stroke of the harness frame in the direction in which the harness frame is drawn by the pulling means.

With such arrangement, if the connecting wires between the shedding motion means and the harness frame slacken as a result of long-term operation of the weaving machine, the extreme upper end of the originally set stroke of the harness frame, namely, the highest predetermined position of the harness frame, becomes displaced upwardly to a position nearer to the pulling means by a distance which is equivalent to the slack of the connecting wires. The sensor type detecting means is thus able to detect the presence of the harness frame at the extreme upper end of the stroke, or the highest position of the harness frame.

BRIEF DESCRIPTION OF THE DRAWINGS

The present invention will now be described with reference to the accompanying drawings, in which.

DETAILED DESCRIPTION OF THE PREFERRED EMBODIMENT

A single preferred embodiment of the present invention will now be described with reference to the accompanying drawings.

Figure 1:
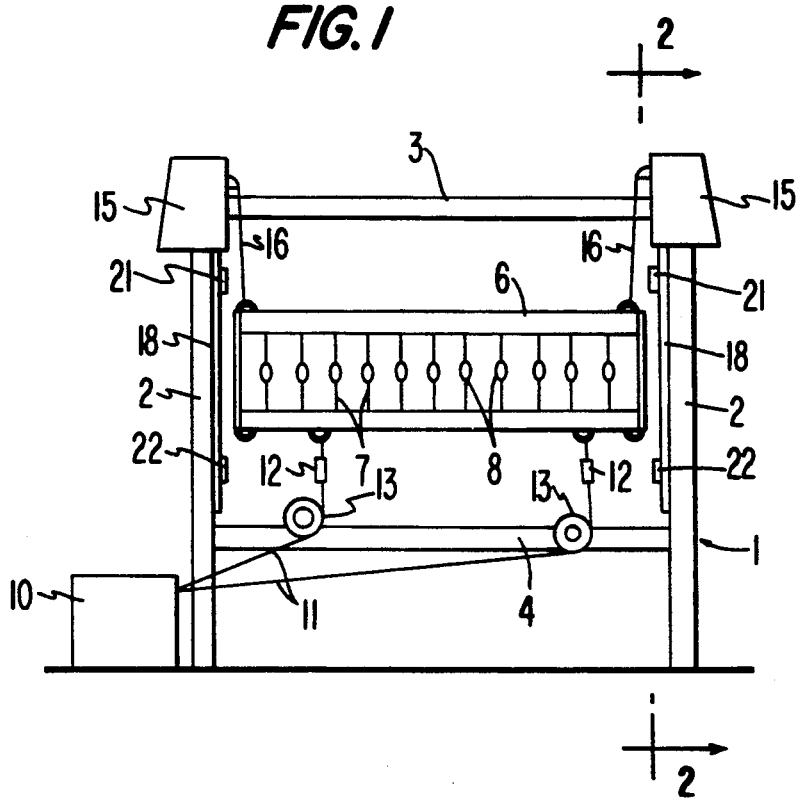
FIG. 1 is a schematic elevational view of the overall arrangement of a weaving machine including a harness frame, a Dobby machine and a sensor type detecting means according to a preferred embodiment of the present invention.

As shown in FIG. 1, a machine frame 1 is provided with a pair of right-hand side and left-hand side vertical supporting members 2 and also with connecting members 3, 4 which join both vertical supporting members 2 at upper and lower portions thereof.

The machine frame 1 has a large number of aluminum harness frames 6 installed in parallel therein, and each harness frame 6 is fitted with a large number of vertical heddles 7 which are aligned with one another.

A shedding motion means 10 which is exemplified in the form of a cam machine in this embodiment of the invention is placed on the same floor surface as the weaving machine is installed. This shedding motion means 10 is connected to the lower ends of both the right-hand side and the left-hand side of each of the harness frames by connecting wires 11. The connecting wires are respectively provided with tension adjusting turnbuckles 12 at their middles. Pulleys 13 serve to guide the connecting wires 11, and are pivoted to the lower connecting member 4 of the machine frame 1.

The machine frame 1 is also equipped with a pair of pulling means 15 at the upper ends of the right-hand side and the left-hand side thereof. These pulling means 15 are operable to draw each harness frame 6 upwardly by way of connecting wires 16.

The vertical supporting members 2 of the machine frame 1 are each provided with a sensor mounting plate 18 of sufficient width to have their inside surfaces oppose the sides of all of the harness frames 6. At least one of the sensor mounting plates 18 has a vertical sensor mounting groove 19 formed therein in opposition to one or both sides of the harness frames.

Each sensor mounting groove 19 is fitted with an upper sensor system 21 and a lower sensor system 22 which together form a single sensor type detecting means. Each sensor type detecting means is opposed to a side surface of the harness frame.

As shown in FIGS. 2-9, each sensor system 21, 22 is engaged with each sensor mounting groove 19 of the sensor mounting plate 18 such that the sensor system can be freely vertically moved to adjust the vertical position thereof, and also, can be freely detached from the sensor mounting plate 18.

The upper sensor system 21 serves to detect when the upper end of one side of the harness frame 6 has reached an extreme upper end of its stroke, or an upper position which is higher than the predetermined proper highest position of the harness frame. On the other hand, the lower sensor system 22 acts to detect when the lower end of one side of the harness frame 6 has reached the lowest predetermined position thereof.

Each sensor system 2!, 22 is shaped to be vertically slender, and comprises a bedplate 24, a slider means 25, a sensor mounting base 26, a sensor 27, a cover member 28 and other necessary elements.

The bedplate 24 comprises a base portion 30 which is brought into contact with the inside surface of the sensor mounting plate 18, and a pair of guide members 31 which are attached to and protrude inwardly from both sides of the base portion 30.

The base portion 30 has a pair of engaging members 32 protruding outwardly from the upper and lower ends thereof, and these engaging members 32 are engaged in the sensor mounting groove 19 of the sensor mounting plate 18 such that the engaging members 32 can be moved vertically, thereby allowing the engaging members 32 to function as sensor guides.

Moreover, the base portion 30 is provided with an inwardly protruding flat plate 33 at one of the upper and lower ends thereof and also with an L-shaped projection 34 at the other end thereof.

In addition to the base portion 30 fitted with the foregoing several members or attachments, the bedplate 24 also comprises a nut 35 secured on the inward side of the base portion 30 at the end thereof nearest the flat plate 33, and a stopper means 36 protruding inwardly from the end of the base portion 30 nearest the flat plate 33.

The end of the base portion 30 nearest the projection 34 is formed with a vertically elongated rectangular wiring opening 37 for insertion of electric wiring.

The bedplate 24 is press-formed of a single metallic plate except for the nut 35.

The nut 35 has a bolt 38 detachably screwed therein, and this bolt 38 is inserted through the sensor mounting groove 19 of the sensor mounting plate 18 and the base portion 30. As a result, the top portion of the bedplate 24 is fixed to the sensor mounting plate 18. The bolt 38 can be vertically moved along the sensor mounting groove 19.

The slider means 25 is inserted between the guide members 31 of the bedplate 24, and is adapted to slide vertically along the base portion 30. The slider means comprises an outside member 39 and an insertion member 40.

The outside member 39 of the slider means 25 comprises a face plate portion 42 which is opposed to the base portion 30 of the bedplate 24, side wall portions 43 which protrude outwardly from both sides of the face plate portion 42 and abut against the guide members 31 of the bedplate 24, and a pair of inwardly extending projections 44, 45 provided at both vertical ends of the face plate portion 42. The one of the inwardly extending projections 44 and 45 nearest the L-shaped projection 34 is formed with a guide aperture 46 in which the end portion of the L-shaped projection 34 is inserted so as to be vertically movable.

The inner portion of the insertion member 40 is inserted between the side wall portions 43 of the outside member 39 and is caulked or spot-welded to the outside member 39 of the slider means is to make the insertion member 40 integral with the outside member 39, while at the same time, the outer portion of the insertion member 40 is inserted between and engaged with both guide members 31 of the bed plate.

A recessed portion 48 is formed in the end of the insertion member 40 nearest the flat plate 33, and the stopper means 36 of the bed plate 24 is inserted in and engaged with this recessed portion 48 such that the stopper means 36 can be vertically moved in the recessed portion 48.

The ends of the outside nearest the L-shaped projection 34 member 39 and the insertion member 40 of the slider means 25 are formed with elongated rectangular wiring openings 50, 51 for insertion of electric wiring.

The end of the slider means 25 nearest the recessed portion 48 is detachably secured to the bedplate 24 by means of a bolt 53, and the head portion of this bolt 53 is inserted through the sensor mounting groove 19 such that it can be vertically moved therein. A vertically elongated bolt hole 54 is formed in the base portion 30.

A channel-shaped sensor mounting base 26 is attached against the substantially vertically middle portion of the inner surface of the outside member 39, while at the same time, an outwardly extending projection 56 formed on the upper end of the sensor mounting base 26 is inserted through the outside member 39 and the insertion member 40 of the slider means 25.

The sensor 27 is fitted in the sensor mounting base 26, and a bolt 58 is inserted from the outside surface of the sensor 27 through the sensor mounting base 26, the slider means 25 and the base portion 30 of the bedplate 24 to thereby secure the sensor 27 on the inside surface of the slider means 25. A vertically elongated nut hole 63 is formed in the base portion 30 to allow the nut 59 to move vertically within the nut hole 63.

The sensor 27 has an electric wire 60 connected to the bottom portion thereof, and this wire 60 is passed outside the sensor mounting plate 18 through the wiring openings 37, 50 and 51 in the bedplate 24, and the insertion member 40 and outside member 39 of the slider means 25, respectively, and also through the sensor mounting groove 19. The inner portion of the upper end of the sensor 27 is formed as a detecting portion 61, and the top portion of the detecting portion 61 is provided with a warning means 62, such as a light emitting diode, which lights up to give an alarm when the sensor has operated.

In this embodiment of the invention, the harness frame 6 is preferably formed of aluminum rather than of ferromagnetic material, as is frequently the case with conventional weaving machines generally in use. Therefore, the harness frame 6 is detachably fitted with small pieces 64 of ferromagnetic iron in the upper and lower ends of both sides thereof, so that the sensor 27 can detect the position of the harness frame 6. Without these ferromagnetic iron pieces 64, the sensor 27 would be unable to detect the position of the harness frame 6.

The cover member 28 is attached to the inside surface of the outside member 39 of the slider means 25 to cover chiefly the sensor 27 and the inside surface of the outside member 39 of the slider means 25. Also, the cover member 28 has a pair of upper and lower nuts 66 embedded in upper and lower portions thereof, and bolts 67 screwed into each nut 66 to achieve the detachable attachment of each sensor system 21, 22 to the sensor mounting plate 18. Specifically, the bolts 67 are inserted through the sensor mounting groove 19 of the sensor mounting plate 18, through bolt holes 68 in the base portion 30 of the bedplate 24, and through the slider means 25. The bolt holes 68 in the base portion 30 are vertically elongated to allow the bolts to be freely moved vertically within these bolt holes 68 and the sensor mounting groove 19.

The upper and lower end portions of the cover member 28 are fitted between the inwardly extending projections 44 and 45 of the outside member 39 of the slider means 25. The upper end portion of the cover member 28 adjacent the recessed portion 48 is formed with a slider knob member 70 protruding inwardly.

The cover member 28 is provided with a window portion 27 in the vertically middle portion thereof to expose the warning means 62 to the outside, while at the same time, the cover member 28 is formed with "diamond-cut" surfaces 73 in the inside surfaces of both side portions and upper and lower portions thereof around the window portion 27 to provide for easier identification of the light emission of the warning means 62. The "diamond-cut" surfaces are formed of a large number of protrusions having pyramidal configurations such as those utilized, for example, for the taillight covers of automobiles.

Figure 2:
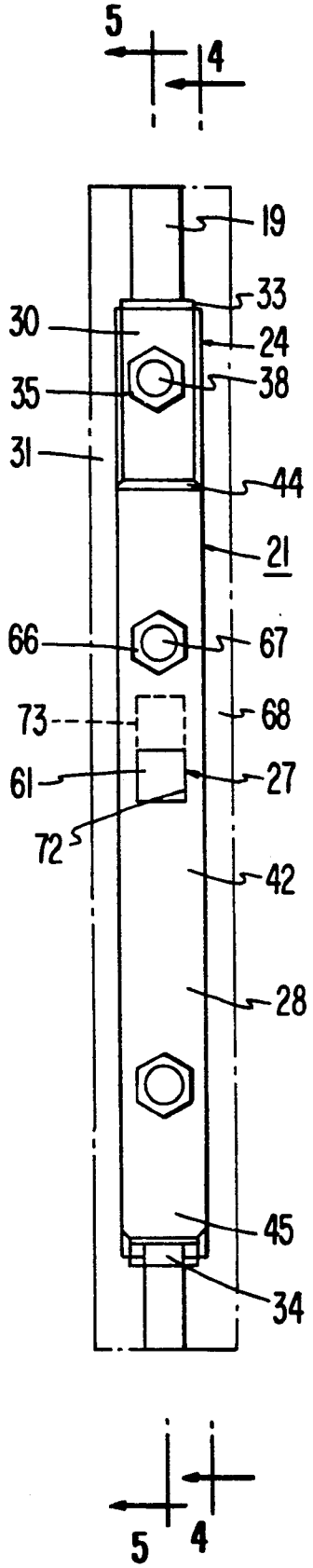
FIG. 2 is a side elevational view taken along the line 2—2 of FIG. 1, showing a single sensor mounting groove having an upper sensor system engaged therewith.
Figure 5:
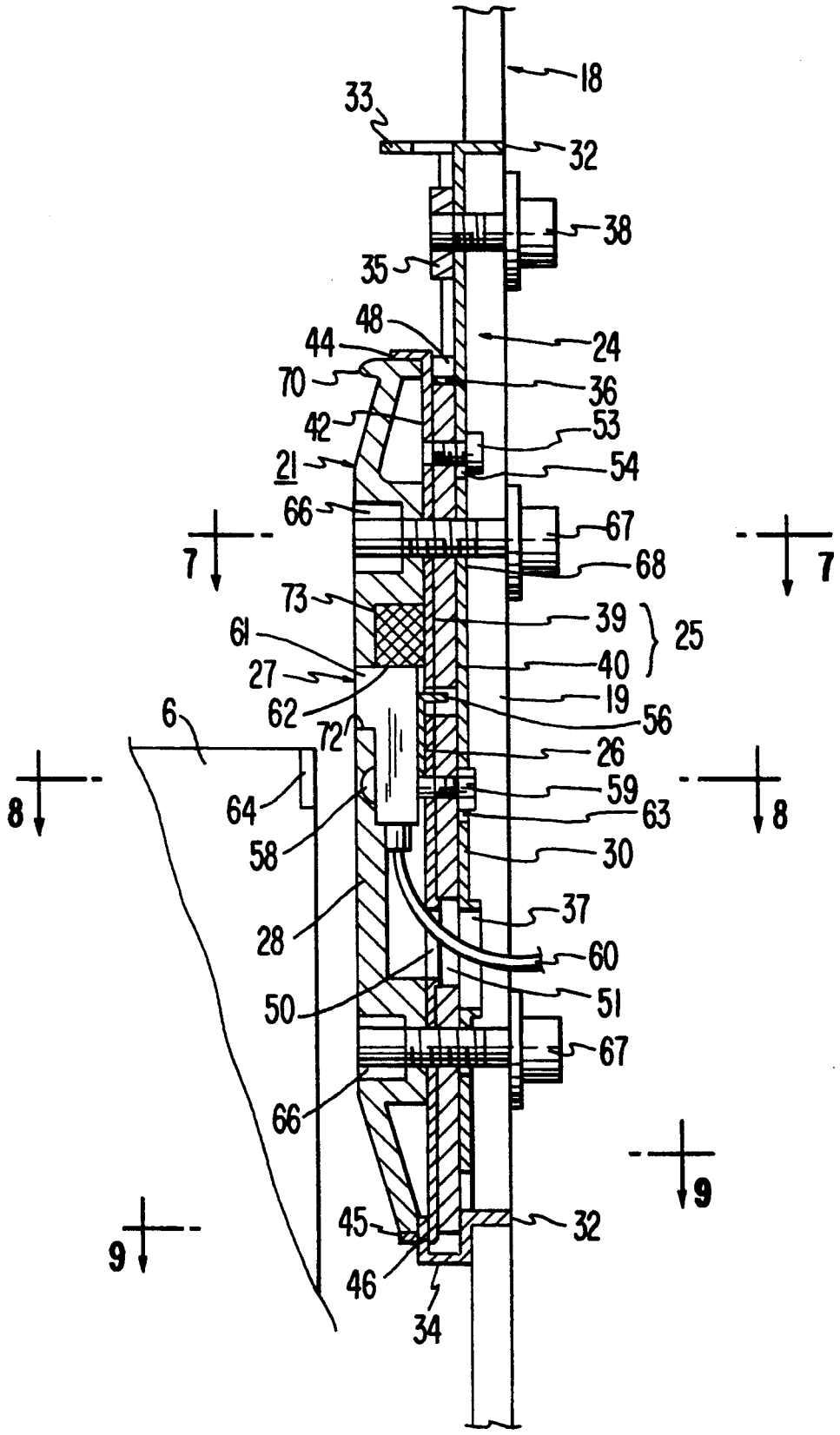

As shown in FIGS. 2 and 5, the upper sensor system 21 is arranged on the sensor mounting plate 18 such that the warning means 62 of the sensor 27 facing upwardly, while on the other hand, the lower sensor system 22 is disposed on the sensor mounting plate 18 with the warning means 62 facing downwardly.

Figure 10:
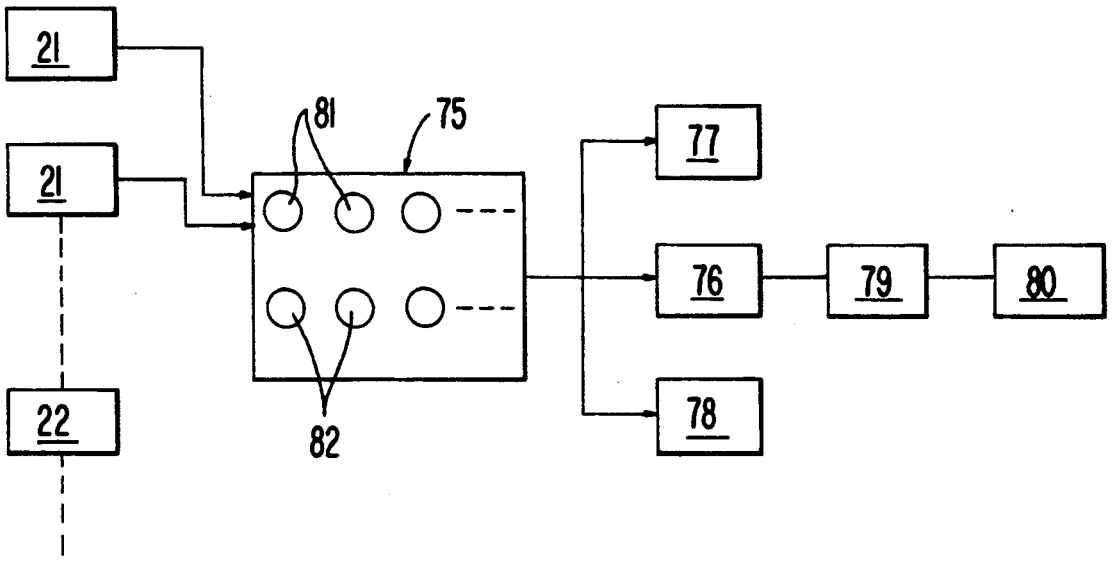
FIG. 10 is a block diagram showing connections between a control panel and sensor systems and other necessary equipments.

FIG. 10 shows a controller means for the single sensor type detecting means, and the sensor systems 21 and 22 are respectively connected to a control panel 75. A buzzer 77 and a rotary type lamp 78 are connected to the control panel 75. The buzzer 77 is equipped with a timer (not shown). The control panel 75 also has a counter unit 79 connected thereto through a reset switch 76 and a relay means (not shown), and the counter unit 79 is connected to an electronic computer 80.

The control panel 75 is provided with a pilot lamp 81 which is connected to the sensor 27 of the upper sensor system 21, and lights up when this sensor 27 has detected that the harness frame 6 is in the highest position thereof. The control panel is also equipped with a pilot lamp 82, and this pilot lamp 82 is connected to the sensor 27 of the lower sensor system 22, and lights up when this sensor 27 has detected that the harness frame 6 is in the lowest predetermined position thereof.

The buzzer 77 and the rotary type lamp 78 both operate when the sensor 27 of the upper sensor system 21 has performed the detecting operation thereof.

The counter unit 79 is arranged to operate only when the reset switch 76 is turned on. This counter unit is provided with a plurality of counters which are operatively associated with the plurality of upper sensor systems for the plurality of harness frames in the weaving machine, respectively. Each counter counts each time that the sensor 27 of a corresponding upper sensor system 21 has operated. Once the sensor 27 of the upper sensor system 21 operates, the relay means also operates to turn off the reset switch. Therefore, the counter always gives a zero indication after having finished the counting operation thereof, and the counter always counts the first operation irrespective of the number of countings carried out by means of the counter.

The number of countings performed by means of the counter of the counter unit 79 is memorized in the electronic computer 80, and is indicated on a display means (not shown) of this computer.

In the embodiment arranged as described in the foregoing, the tension adjusting turnbuckles 12 provided in the middles of the connecting wires between each harness frame 6 and the shedding motion means 11 are regulated to set the highest predetermined position and the lowest predetermined position of the harness frame 6, thereby allowing a shedding amount to be predetermined as desired.

In order to position the upper sensor system 21 and the lower sensor system 22, the reset switch 76 is first turned off. Then, the harness frame 6 is lifted to the highest predetermined position thereof which corresponds to the predetermined shedding amount, and the upper sensor system 21 is secured on the sensor mount plate 18, with the warning means 62 thereof facing upwardly.

Figure 6:
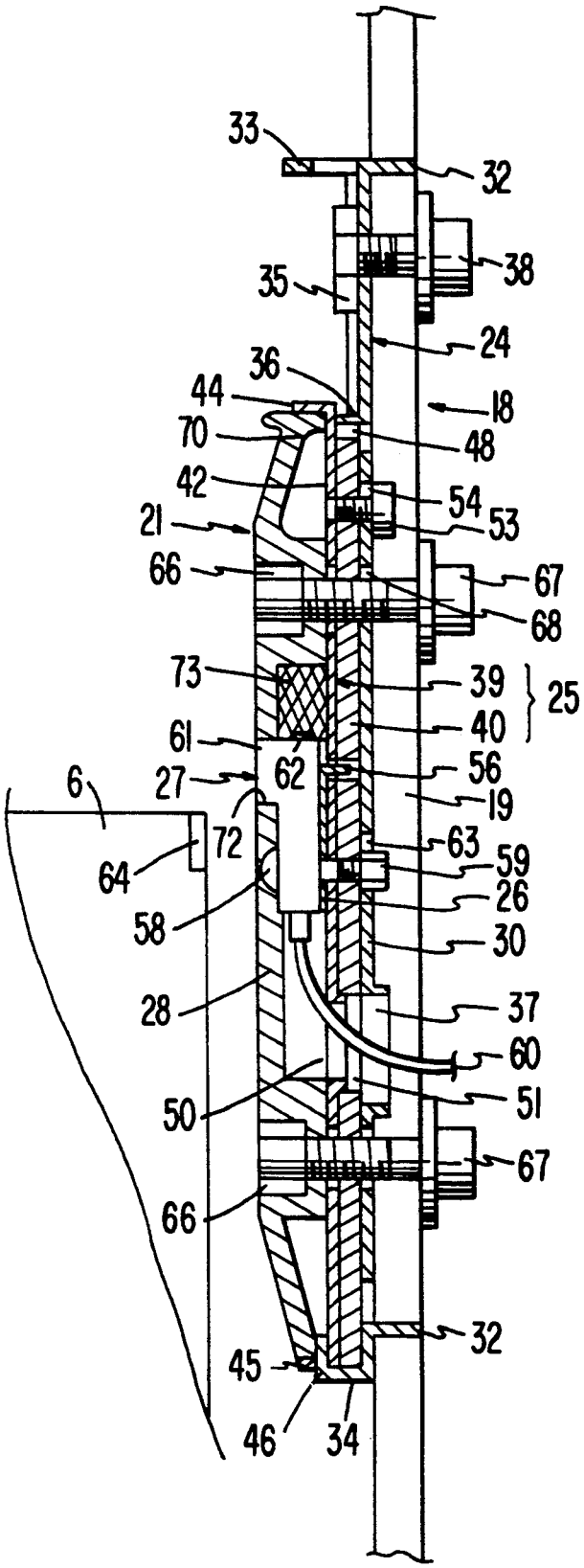
FIG. 6 is a cross sectional view which shows a method for adjusting.
Figure 7:
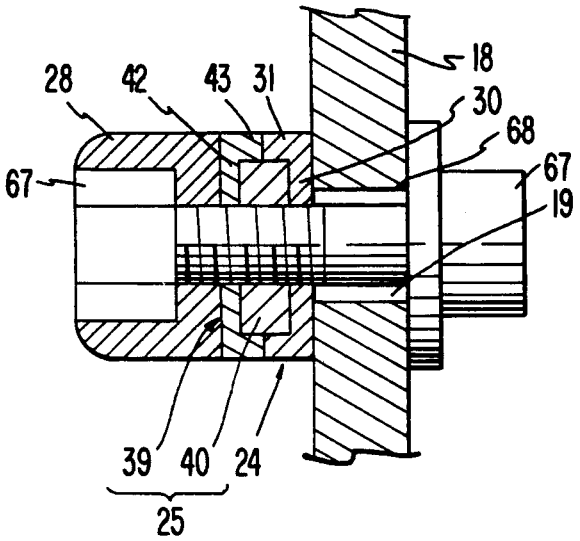
FIGS. 7 to 9 are cross sectional views respectively taken along the lines 7—7, 8—8 and 9—9 of FIG. 5.
Figure 8:
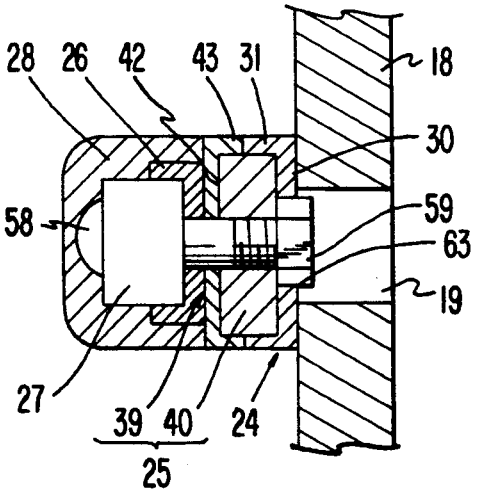
Figure 9:
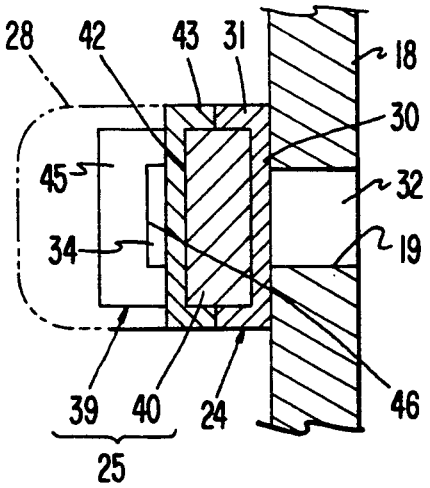

In this case, as shown in FIG. 6, the slider means 25 is located in the lowest position thereof relative to the base portion 30 of the bedplate 24 so that the lower inwardly extending projection 45 of the slider means 25 is brought into contact with the L-shaped projection 34 of the bedplate 24. In this condition, the bolt 53 is lightly tightened, and the upper sensor system 21 is fixed on the sensor mounting plate 18 in the lowest position thereof at which the sensor 27 thereof is adapted to detect the upper end of the harness frame 6. In order to carry out this fixation of the upper sensor system 21 on the sensor mounting plate 18, the bolt 38 is firmly screwed into the nut 35 through the bedplate 24, while on the other hand, the bolt 67 is lightly tightened.

Figure 3:
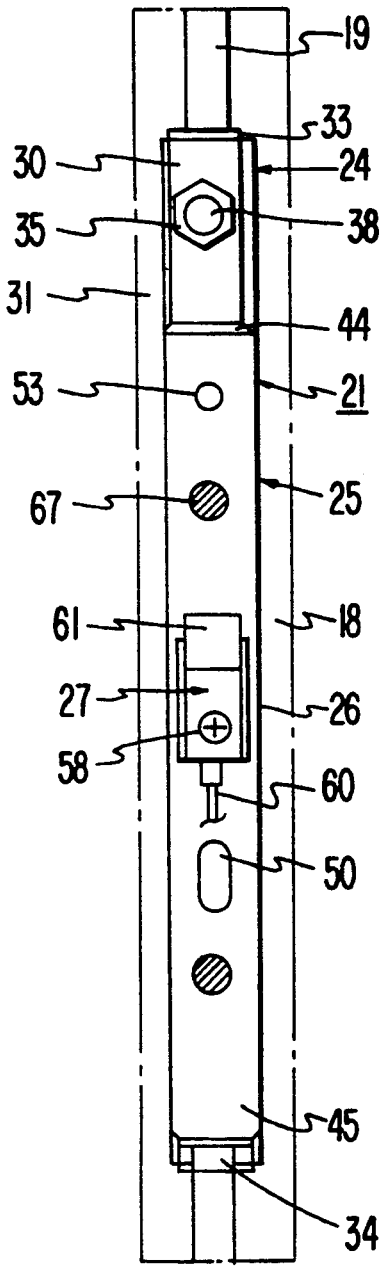
FIG. 3 is a view similar to FIG. 2, but showing a mounting plate for the sensor type detecting means, with a cover member detached.
Figure 4:
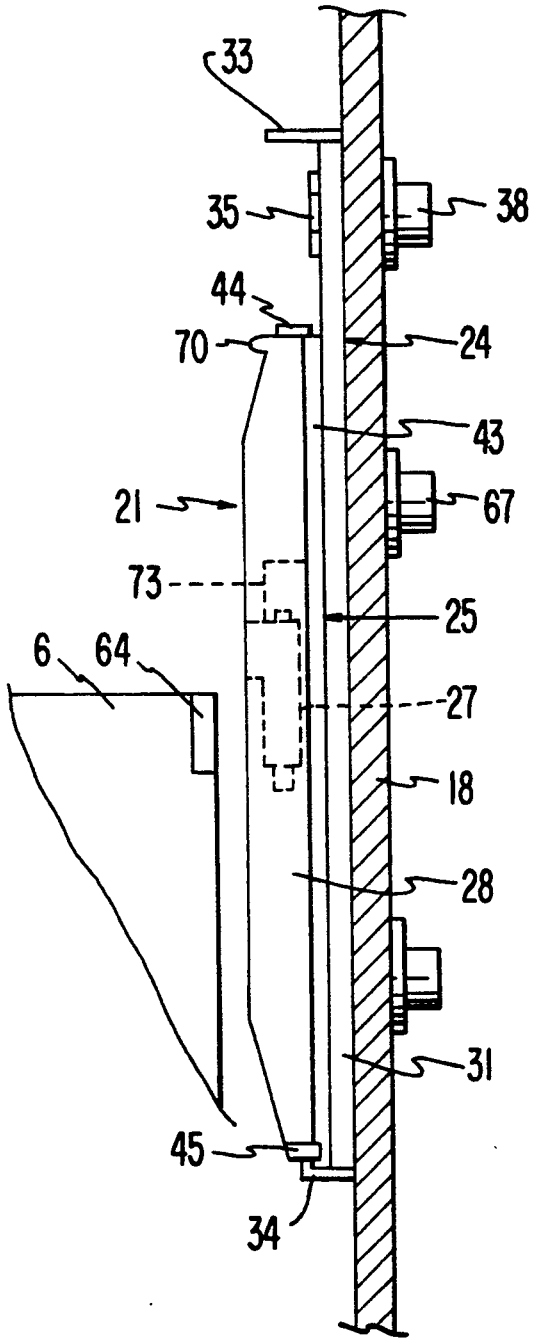
FIGS. 4 and 5 are longitudinal sectional views respectively taken along the lines 4—4 and 5—5 of FIG. 2.

Subsequently, the bolt 53 is untightened to allow the slider means 25 to be moved with respect to the bedplate 24, and as shown in FIGS. 2 to 4 and particularly in FIG. 5, the slider means 25 can be raised to any desired possible level, for example, to such height that the slider means 25 brings the bottom surface of the recessed portion 48 of the insertion member 40 thereof into contact with the stopper means 36 of the bedplate 24. However, the amount which the slider means 25 is raised is required to correspond to the allowable amount of slack in the connecting wires 11, namely, the allowable amount of decrease in the shedding amount. The bolt 53 and the bolt 67 are screwed into the bedplate 24 and the slider means to secure the slider means 25 on the bedplate 24, whereby the sensor 27 of the upper sensor system 21 is prevented from detecting the upper end portion of the harness frame 6 in the highest predetermined position thereof.

Next, the harness frame 6 is lowered to the lowest predetermined position thereof, and the lower sensor system 22 is secured on the sensor mounting plate 18 such that the warning means 62 of the sensor 27 is facing downwardly. In this case, the lower sensor system 22 is located on the sensor mounting plate 18 in the lowest position thereof at which the sensor 27 of the lower sensor system 22 is adapted to detect the lower end of the harness frame 6 in the lowest predetermined position thereof.

In so far as the lower sensor system 22 is concerned, the slider means 25 may be located in any vertical position relative to the bedplate 24.

In order to operate the weaving machine with the position detecting means of the present invention mounted thereon, the reset switch 76 is first turned on, and the shedding motion means 10 is then operated. As a result, the pulling means 15 are also actuated, and the harness frames 6 are allowed to ascend and descend.

While the weaving machine is thus in operation, the sensor 27 of the lower sensor system 22 detects the lower end of the harness frame 6 to thereby allow the warning means 62 of the sensor 27 and the pilot lamp 83 to light up when the harness frame 6 has reached the lowest predetermined position thereof.

If the weaving machine is operated over a long period of time, the connecting wires 11 between the shedding motion means 10 and the harness frame 6 become slackened, and accordingly, the highest and the lowest predetermined positions of the harness frame 6 gradually rise in level. As a result, even when the harness frame 6 reaches its lowest position, the sensor 27 of the lower sensor system 22 cannot detect it. This naturally prevents the operation of the warning means 62 of the sensor 27 and also that of the pilot lamp 83 which is intended to light up when the sensor 27 has detected the harness frame.

Moreover, if the connecting wires 11 between the shedding motion means 10 and the harness frame 6 continuously slacken, the sensor 27 of the upper sensor system 21 will detect the upper end of the harness frame 6 when the harness frame 6 has reached the highest position thereof as set. As a result, the warning means 62 of the sensor 27 of the upper sensor system 21, a corresponding pilot lamp 81 on the control panel, the buzzer 77, and the rotary type lamp 78 are all operated to warn that the harness frame has been raised above the highest predetermined position. Also, a corresponding counter of the counter unit 79 counts the first time in response to this detection of the upper end of the harness frame. In this case, the relay means (not shown) also operates, and the reset switch 76 is accordingly turned off.

If the slack of the connecting wires 11 between the harness frame and the shedding motion means is identified as described in the foregoing, a resulting decrease in the shedding amount occurs to obtain the shedding amount predetermined by means of the shedding motion means 10. Firstly, the weaving machine is brought to a stop, and thereafter, the harness frame 6 is shifted to the lowest position attainable with the slackened connecting wires 11 which is higher than the proper lowest position which corresponds to the shedding amount set by means of the shedding motion means 10. The tension adjusting turnbuckles 12 are then adjusted to lower the harness frame 6 until the sensor 27 of the lower sensor system 22 detects the lower end of the harness frame 5, and the warning means 62 thereof consequently lights up, whereby the shedding amount is restored to the original predetermined proper shedding amount.

If the connecting wires 11 from the harness frame to the shedding motion means differ with respect to one another in the amount of slack to such a degree that the harness frame 6 becomes skewed (i.e. not horizontal), this irregular state of the harness frame can easily be detected, because a single unit of the sensor system can be arranged on both side vertical supporting members of the machine frame 1. That is to say, the slack identifying means in the present invention includes the warning means 62 of the sensor 27, and the pilot lamps 81 and 82 of the control panel 75, and the lighting of only some of these identifying means will show that the harness frame is not in its horizontal condition.

Also, if the turnbuckles 12 are adjusted while the slack identifying means, such as the pilot lamps, are being watched, the orientation of the harness frame 6 can easily be adjusted.

If one or both of the turnbuckles 12 have already been adjusted to the maximum extent possible, the reset switch 76 is turned on to reinstitute the weaving operation of the weaving machine.

The long-term operation of the weaving machine causes each counter of the counter unit 79 to gradually increase the number counted, and the identification of the number counted gives knowledge of the total slack of the connecting wires 11 since their operation began. This allows for an easy understanding of the time at which one or both of the connecting wires 11 should be replaced with a new one or new ones.

If the replacement of the connecting wire or wires with a new one or new ones is completed, one or both of the turnbuckles 12 located in the middles of the connecting wires 11 between the shedding motion means and the harness frame are adjusted to regulate their tension, while it is being determined whether or not the warning means 62 of the sensor 27 of the lower sensor system 22, and the pilot lamp 82 of the control panel 75 respectively light up, and the highest and the lowest predetermined positions of the harness frame 6 are respectively reset as originally properly set, thereby allowing the original proper shedding amount to be obtained.

The shedding motion means 10 is occasionally adjusted in the internal shedding mechanism thereof to change the size of sheds formed in the warps thereby. In this case, the highest and the lowest position of the harness frame are also varied, and the position detecting system of the present invention can readily shift the upper and the lower sensor systems to conform to the variation in the highest and the lowest positions of the harness frame.

In the embodiment of the invention, the slider means 25 of the lower sensor system 22 is formed with the recessed portion 48 in the upper end portion of the insertion member 39 thereof. However, since the slider means 25 of the lower sensor system 22 is not required to be moved after the bedplate of the lower sensor system has been fixed on the sensor mounting plate, the slider means of this lower sensor system is not necessarily provided with the recessed portion 48.

Also, in the embodiment, the cover member 28 has the nut 66 embedded therein. However, this nut is not required to be embedded, and may be merely attached to the bolt 67 inserted through the sensor mounting plate, the bedplate and the slider means.

Moreover, in the embodiment, the harness frame is arranged to be drawn downwardly by means of the shedding motion means 10. However, if a Dobby machine is used as the shedding motion means, and is located in the upper portion of the weaving machine in which the pulling means is presently placed, the harness frame will be drawn upwardly rather than downwardly. In this case, the pulling means are naturally shifted to the floor surface on which the cam machine is placed.

As specifically described in the foregoing, the present invention can easily detect when the connecting wires between the shedding motion means and the harness frame becomes slackened such that the shedding amount set by means of the shedding motion means can not be maintained and is accordingly diminished.

Also, the highest and the lowest positions of the harness frame can be corrected when the connecting wires between the shedding motions means and the harness frame have slackened during operation of the weaving machine and also when the connecting wires have been replaced with new ones. In these cases, the position detecting system of the present invention facilitates the adjustment of a diminished shedding amount to an original predetermined proper shedding amount, because in the present invention, the lower sensor system is additionally provided to detect the harness frame in its lowest predetermined position.

Moreover, the position detecting system of the present invention can easily respond to a variation in the shedding amount set by means of the shedding motion means, because this detecting system is arranged to be easily adjusted vertically.

In the present invention, upper and the lower sensor systems are also located on both sides of the machine frame 1. Therefore, if the connecting wires between the shedding motion means and the harness frame differ in the amount of slack therebetween to thereby cause the harness frame to be skewed, both side sensor systems located in the machine frame allow for easy detection of the skewed orientation of the harness frame, thereby facilitating the remedy of the irregular posture of the harness frame.

Also, in the present invention, the slider means 25 is arranged on the bedplate 24 such that the slider means can be vertically moved. Therefore, it is easy to set an allowable amount of slack of the connecting wires 11, namely, the allowable amount of decrease in the shedding amount.

As is apparent from the foregoing description, the position detecting system according to the present invention for the harness frame of a negative type weaving machine is advantageous in that it provides the discovery of slack in the connecting wires between the harness frame and the shedding motion means, to thereby prevent trouble such as the frequent production of defective products as occurred with the conventional type weaving machines having not detector means capable of discovering the slack of the connecting wires between the shedding motion means and the harness frame.

Although the present invention has been fully described by way of a single example with reference to the accompanying drawings, it is to be noted that various changes and modifications will be apparent to those skilled in the art. Therefore, unless such changes and modifications otherwise depart from the scope of the present invention, they should be construed as being included therein.

What is claimed is:

1. A position detecting system for use with a weaving machine having a supporting frame, a harness frame, a shedding motion means connected to the harness frame by first connecting wires for moving the harness frame in one of upward and downward directions relative to the supporting frame, and pulling means connected to the harness frame by second connecting wires for moving the harness frame in the other of the upward and downward directions relative to the supporting frame, said position detecting system comprising:

a first sensor system means, adapted to be vertically adjustably mounted to the supporting frame, for sensing when the harness frame is in one of an extreme upper position and an extreme lower position relative to the supporting frame;

A second sensor system means, adapted to be vertically adjustably mounted to the supporting frame, for sensing when the harness frame is in the other of the extreme upper position and the extreme lower position relative to the supporting frame;

wherein a sensor mounting plate is adapted to be mounted to the supporting frame; and wherein each of said first and second sensor system means comprises a bedplate vertically adjustably mounted to said sensor mounting plate, a sensor means for detecting the presence or absence of the harness frame in a predetermined position, and a slider means, mounted to said sensor means and vertically adjustably mounted to said bedplate, for slidably mounting said sensor means to said bedplate.

2. A position detecting system as recited in claim 1, wherein said slider means is operable to mount said sensor means to said bed plate in such a manner that said sensor means is mounted directly opposite a face of said sensor mounting plate.

3. A position detecting system as recited in claim 2, wherein said sensor mounting plate has a vertically extending sensor mounting groove formed therein; and said bedplate includes portions thereof extending into said sensor mounting groove for slidable engagement with said sensor mounting plate.

4. A position detecting system for use with a weaving machine having a supporting frame, a harness frame, a shedding motion means connected to the harness frame by first connecting wires for moving the harness frame in one of upward and downward directions relative to the supporting frame, and pulling means connected to the harness frame by second connecting wires for moving the harness frame in the other of the upward and downward directions relative to the supporting frame, said position detecting system comprising:

a sensor system means, adapted to be vertically adjustably mounted to the supporting frame, for sensing when the harness frame is in one of an extreme upper position and an extreme lower position relative to the supporting frame; and wherein a sensor mounting plate is adapted to be mounted to the supporting frame; and said sensor system means comprises a bedplate vertically adjustably mounted to said sensor mounting plate, a sensor means for detecting the presence or absence of the harness frame in a predetermined position, and a slider means, mounted to said sensor means and vertically adjustably mounted to said bedplate, for slidably mounting said sensor means to said bedplate.

5. A position detecting system as recited in claim 4, wherein said slider means is operable to mount said sensor means to said bed plate in such a manner that said sensor means is mounted directly opposite a face of said sensor mounting plate.

6. A position detecting system as recited in claim 5, wherein said sensor mounting plate has a vertically extending sensor mounting groove formed therein; and said bedplate includes portions thereof extending into said sensor mounting groove for slidable engagement with said sensor mounting plate.

7. A weaving machine comprising:

a supporting frame;

a harness frame mounted to said supporting frame;

shedding motion means for moving the harness frame in one of upward and downward directions relative to the supporting frame;

first connecting wires connected between said harness frame and said shedding motion means;

pulling means for moving the harness frame in the other of the upward and downward directions relative to the supporting frame;

second connecting wires connected between said harness frame and said pulling means; and at least one position detecting system including a first sensor system means, vertically adjustably mounted to said supporting frame, for sensing when said harness frame is in one of an extreme upper position and an extreme lower position relative to said supporting frame, and a second sensor system means, vertically adjustably mounted to said supporting frame, for sensing when said harness frame is in the other of said extreme upper position and said extreme lower position relative to said supporting frame.

8. A weaving machine as recited in claim 7, wherein each of said first and second sensor system means comprises a bedplate vertically adjustably mounted to said supporting frame, a sensor means for detecting the presence or absence of said harness frame in a predetermined position, and a slider means, mounted to said sensor means and vertically adjustably mounted to said bedplate, for slidably mounting said sensor means to said bedplate.

9. A weaving machine as recited in claim 8, wherein said at least one position detecting system further comprises a sensor mounting plate mounted to said supporting frame, said bedplate of each of said first and second sensor system means being vertically adjustably mounted to said sensor mounting plate.

10. A weaving machine as recited in claim 9, wherein said sensor mounting plate has a vertically extending sensor mounting groove formed therein; and said bedplate includes portions thereof extending into said sensor mounting groove for slidable engagement with said sensor mounting plate.

11. A weaving machine as recited in claim 10, wherein said supporting frame comprises a pair of vertical supporting frame members spaced apart from one another; and said at least one position detecting system comprises two position detecting systems, each of which is mounted on a respective one of said pair of vertical supporting frame members.

12. A weaving machine as recited in claim 7, wherein said supporting frame comprises a pair of vertical supporting frame members spaced apart from one another; and said at least one position detecting system comprises two position detecting systems, each of which is mounted on a respective one of said pair of vertical supporting frame members.

13. A weaving machine comprising:

a supporting frame;

a harness frame mounted to said supporting frame;

shedding motion means for moving the harness frame in one of upward and downward directions relative to the supporting frame;

first connecting wires connected between said harness frame and said shedding motion means;

pulling means for moving the harness frame in the other of the upward and downward directions relative to the supporting frame;

second connecting wires connected between said harness frame and said pulling means; and at least one position detecting system including a sensor system means, vertically adjustably mounted to said supporting frame, for sensing when said harness frame is in one of an extreme upper position and an extreme lower position relative to said supporting frame, and wherein said sensor system means comprises a bedplate vertically adjustably mounted to said supporting frame, a sensor means for detecting the presence or absence of said harness frame in a predetermined position, and a slider means, mounted to said sensor means and vertically adjustably mounted to said bedplate, for slidably mounting said sensor means to said bedplate.

14. A weaving machine as recited in claim 13, wherein said at least one position detecting system further comprises a sensor mounting plate mounted to said supporting frame, said bedplate of said sensor system means being vertically adjustably mounted to said sensor mounting plate.

15. A weaving machine as recited in claim 14, wherein said sensor mounting plate has a vertically extending sensor mounting groove formed therein; and said bedplate includes portions thereof extending into said sensor mounting groove for slidable engagement with said sensor mounting plate.

16. A weaving machine as recited in claim 15, wherein said supporting frame comprises a pair of vertical supporting frame members spaced apart from one another; and said at least one position detecting system comprises two position detecting systems, each of which is mounted on a respective one of said pair of vertical supporting frame members.

17. A weaving machine as recited in claim 13, wherein said supporting frame comprises a pair of vertical supporting frame members spaced apart from one another; and said at least one position detecting system comprises two position detecting systems, each of which is mounted on a respective one of said pair of vertical supporting frame members.

18. A weaving machine as recited in claim 13, wherein said at least one position detecting system is mounted to said supporting frame in a position such that said sensor means is operable to detect when one of an upper and a lower end of said harness frame is moved vertically passed said sensor means.

* * * * *